US010256558B2

(12) United States Patent
Moriyasu et al.

(10) Patent No.: US 10,256,558 B2
(45) Date of Patent: Apr. 9, 2019

(54) CARD EDGE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Masanori Moriyasu, Mie (JP); Masaaki Tabata, Mie (JP); Hidetoshi Ishida, Mie (JP); Hajime Matsui, Mie (JP)

(73) Assignees: AutoNetworks Technologies, Ltd. (JP); Sumitomo Wiring Systems, Ltd (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/755,677

(22) PCT Filed: Aug. 17, 2016

(86) PCT No.: PCT/JP2016/073980
§ 371 (c)(1),
(2) Date: Feb. 27, 2018

(87) PCT Pub. No.: WO2017/043273
PCT Pub. Date: Mar. 16, 2017

(65) Prior Publication Data

US 2019/0027849 A1 Jan. 24, 2019

(30) Foreign Application Priority Data

Sep. 7, 2015 (JP) ..... 2015-175528

(51) Int. Cl.
*H01R 13/62* (2006.01)
*H01R 12/72* (2011.01)
(Continued)

(52) U.S. Cl.
CPC ..... *H01R 12/721* (2013.01); *H01R 12/7005* (2013.01); *H01R 12/89* (2013.01); *H01R 13/193* (2013.01); *H01R 13/629* (2013.01)

(58) Field of Classification Search
CPC ..... H01R 23/684; H01R 23/6833
(Continued)

(56) References Cited

U.S. PATENT DOCUMENTS 8,385,080 B2 * 2/2013 Kim ..... H05K 7/00 361/760
8,613,831 B2 * 12/2013 Wild ..... D21H 17/28 162/135
(Continued)

FOREIGN PATENT DOCUMENTS

| | | |
|---|---|---|
| JP | 2010-108620 | 5/2010 |
| JP | 2013-20808 | 1/2013 |
| JP | 2013-20809 | 1/2013 |

OTHER PUBLICATIONS

International Search Report dated Nov. 1, 2016.

*Primary Examiner* — Phuong Chi T Nguyen
(74) *Attorney, Agent, or Firm* — Gerald E. Hespos; Michael J. Porco; Matthew T. Hespos

(57) ABSTRACT

A movable member (30) provided in a housing (10) is formed with a cover (32) configured to cover inserting edges (45) on a tip of a circuit board (41) in an inserting direction into a board accommodation space (15) when the circuit board (41) is inserted into the board accommodation space (15) and a receiving surface (34) configured to move the movable member (30) integrally with the circuit board (41) to a back side of the board accommodation space (15) by being pushed by the circuit board (41). The movable member (30) and the circuit board (41) are formed with locks (38, 46) configured to move the movable member (30) integrally
(Continued)

with the circuit board (41) in a withdrawing direction from the board accommodation space (15) by locking each other.

4 Claims, 7 Drawing Sheets

(51) Int. Cl.
*H01R 12/89* (2011.01)
*H01R 13/629* (2006.01)
*H01R 13/193* (2006.01)
*H01R 12/70* (2011.01)

(58) Field of Classification Search
USPC ..... 439/260, 267
See application file for complete search history.

(56) References Cited

U.S. PATENT DOCUMENTS

| | | | | |
|---|---|---|---|---|
| 8,684,766 | B2 * | 4/2014 | Kakino | H01R 12/88 439/260 |
| 8,814,594 | B2 * | 8/2014 | Miyazaki | H01R 12/55 439/260 |
| 8,988,629 | B2 * | 3/2015 | Kuo | H05K 9/0054 349/58 |
| 2013/0017702 | A1 | 1/2013 | Kamiya et al. | |

* cited by examiner

CARD EDGE CONNECTOR

BACKGROUND

Field of the Invention

The invention relates to a card edge connector.

Description of the Related Art

Japanese Unexamined Patent Publication No. 2010-108620 discloses a card edge connector with a housing having a board accommodation space. Terminal fittings are accommodated in the housing and are arranged to face each other across the board accommodation space. This card edge connector comes into contact with a circuit board inserted into the board accommodation space with resilient contact pieces provided on the terminal fittings resiliently deformed. A predetermined contact pressure is ensured between the terminal fittings and the circuit board by a resilient contact action of the resilient contact pieces. Further, the resilient deformation of the resilient contact pieces takes up dimensional tolerances of the housing, the terminal fittings and the circuit board. Thus, a structure for bringing the resiliently deformed contact pieces into contact with the circuit board is necessary to ensure contact reliability between the terminal fittings and the circuit board.

However, the structure for bringing the resiliently deformed contact pieces into contact with the circuit board can cause corner edges of a tip of the circuit board in an inserting direction to butt against the resilient contact pieces or to be abraded strongly against the resilient contact pieces in the process of inserting the circuit board into the board accommodation space. Such butting or abrasion leads to the peeling of platings of contact portions of the resilient contact pieces or the shaving of the corner edges of the circuit board. These shavings can be caught between the resilient contact pieces and the circuit board, and can eventually cause a contact failure.

The invention was completed on the basis of the above situation and aims to improve contact reliability.

SUMMARY

The invention is directed to a card edge connector with a circuit board and a housing. A board accommodation space is formed in the housing and is configured such that the circuit board can be inserted therein from the front of the housing. A terminal fitting is mounted in the housing and has a resilient contact piece that can resiliently contact the circuit board inserted into the board accommodation space. A movable member is provided in the housing. A cover is formed on the movable member and is configured to cover an inserting end edge on a tip of the circuit board in an inserting direction into the board accommodation space when the circuit board is inserted into the board accommodation space. A guide is configured to guide the movable member between an initial position where the cover is located at an entrance of the board accommodation space and a connection position where the cover is located backward of the resilient contact piece. A receiving surface is formed on the movable member and is configured to be pushed by the circuit board and to move the movable member integrally with the circuit board to a back side of the board accommodation space. Locks are formed on the circuit board and the movable member. The locks are lockable to each other and move the movable member integrally with the circuit board in a withdrawing direction from the board accommodation space.

The cover covers the inserting edge of the circuit board when inserting the circuit board into the board accommodation space. Thus, there is no possibility that the resilient contact piece of the terminal fitting interferes with the inserting edge of the circuit board. Accordingly, a contact failure due to the interference of the resilient contact piece and the inserting edge of the circuit board can be prevented. Further, a locking action of the locks occurs when withdrawing the circuit board from the board accommodation space after the circuit board is moved to the back side of the board accommodation space and returns the movable member to the initial position integrally with the circuit board. Thus, even if the circuit board repeatedly is inserted into and withdrawn from the board accommodation space, the interference of the inserting end edge of the circuit board and the resilient contact piece of the terminal fitting is prevented.

The receiving surface may be formed on the cover. According to this configuration, the shape of the movable member can be simplified.

The movable member may be formed with a deflectable locking piece, and the housing may be formed with a holding portion configured to hold the movable member at the initial position by locking the deflectable locking piece. According to this configuration, the movable member can be held at the initial position by the holding portion in withdrawing the circuit board from the board accommodation space. Thus, the movable member need not be mounted into the housing when the circuit board is inserted into the board accommodation space again.

The cover may be long and narrow along the board accommodation space, and two of the deflectable locking pieces may be connected to both end parts of the cover. According to this configuration, the movable member can be held at the initial position without being inclined by locking the pair of deflectable locking pieces and the holding portion to each other.

DETAILED DESCRIPTION

Figure 1:
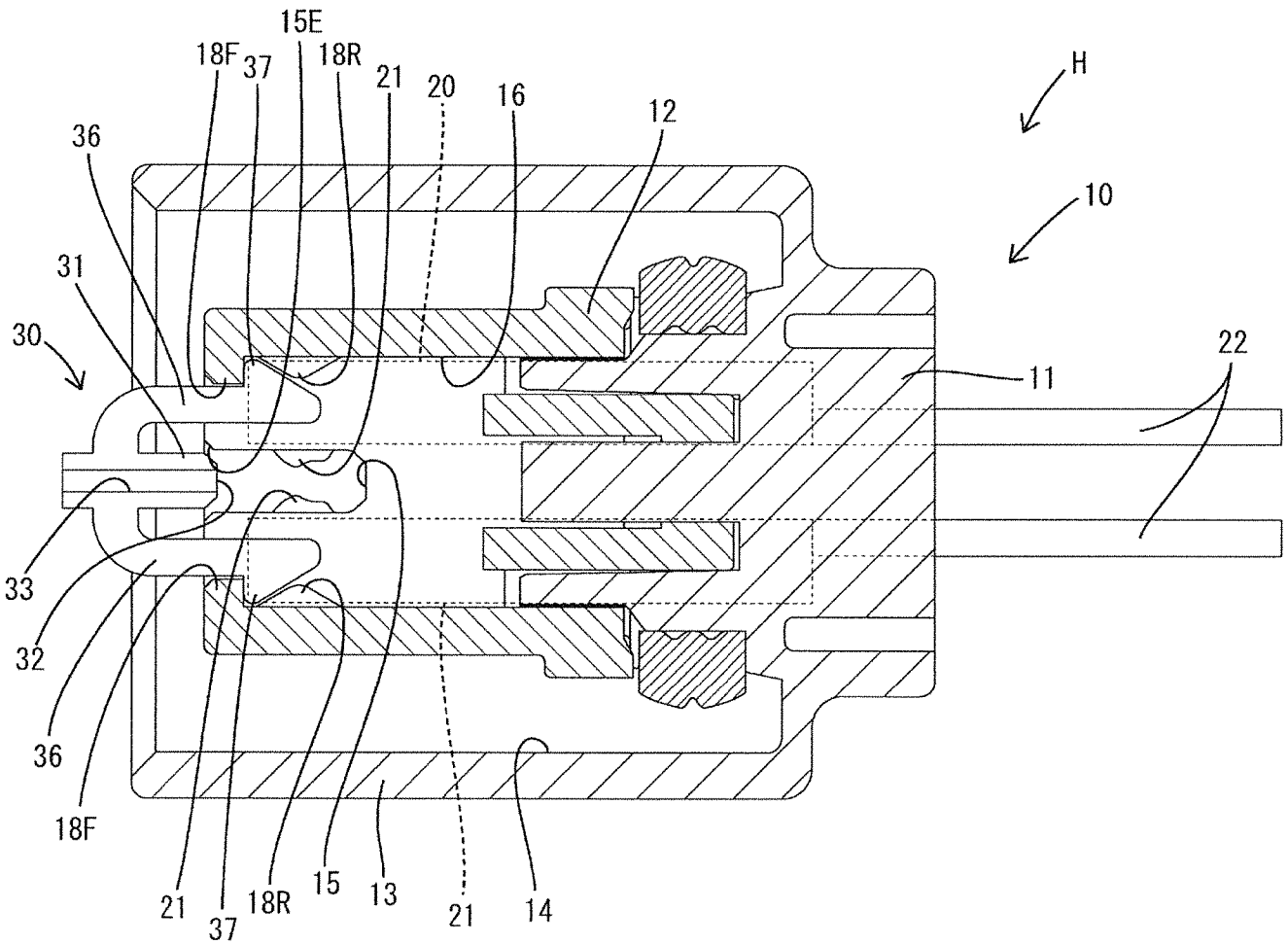
FIG. 1 is a side view in section of a harness-side connector of one embodiment.

Hereinafter, one specific embodiment of the present invention is described with reference to FIGS. 1 to 7. In this embodiment, a left side in FIGS. 1 to 5 is defined as a front concerning a front-rear direction. Upper and lower sides shown in FIGS. 1 to 5 are defined as upper and lower sides concerning a vertical direction. A card edge connector of this embodiment includes a harness-side connector H shown in FIG. 1 and a board-side connector P shown in FIG. 2. The board-side connector P is connected to the harness-side connector H from the front.

The harness-side connector H includes a housing 10, terminal fittings 20 and a movable member 30. The housing 10 includes a housing body 11 and a front holder 12 mounted into the housing body 11 from the front. The housing body 11 is formed with a tubular fitting 13 in the form of a rectangular tube projecting forward and surrounding the front holder 12. A space between the front holder 12 and the tubular fitting 13 serves as a connection space 14 that is open in the front end surface of the housing 10 and into which the board-side connector P is fit.

A board accommodation space 15 is formed inside the housing 10 and defines a laterally long slit open in the front end surface of the housing 10. A circuit board 41 having horizontally oriented plate surfaces is inserted into the board accommodation space 15 from the front of the housing 10. The terminal fittings 20 are accommodated in the front holder 12 while being arranged side by side at predetermined intervals in a lateral direction (width direction) in each of upper and lower stages. The terminal fittings 20 are long and narrow in the front-rear direction, and a wire 22 is connected to a rear end part of each terminal fitting 20.

The terminal fittings 20 in the upper stage and those in the lower stage face each other in a vertically symmetrical orientation. A resilient contact piece 21 is formed on a front end part of the terminal fitting 20 in the upper stage and is resiliently deflectable upward (direction intersecting substantially at a right angle to an inserting direction of the circuit board 41 into the board accommodation space 15). A resilient contact piece 21 is formed on a front end part of the terminal fitting 20 in the upper stage and is resiliently deflectable downward (direction intersecting substantially at a right angle to the inserting direction of the circuit board 41 into the board accommodation space 15). The resilient contact piece 21 in a free state where the resilient contact piece 21 is not resiliently deflected is located in an entrance path for the circuit board 41 in the board accommodation space 15. A minimum facing distance between the resilient contact pieces 21 in the free state vertically facing each other in the board accommodation space 15 is shorter than a thickness (vertical dimension) of a connecting edge 43 of the circuit board 41.

Left and right guide spaces 16 are formed respectively in left and right end parts of the front holder 12 and open in the front surface of the housing 10. Heights of the guide spaces 16 are larger than that of the board accommodation space 15 and vertically central parts of the guide spaces 16 communicate with left and right end parts of the board accommodation space 15. Bases 31 and deflectable locking pieces 36 of the movable member 30 to be described later are accommodated into the left and right guide spaces 16.

Two guide ribs 17 project respectively from left and right side walls of the front holder 12 and are in vertically central parts of the respective left and right guide spaces 16. The guide ribs 17 extend linearly in the front-rear direction and are parallel to inserting and withdrawing directions of the circuit board 15 into and from the board accommodation space 15. The guide ribs 17 guide the movable member 30 in the front-rear direction.

Each of the left and right guide spaces 16 have front and rear holding portions 18F, 18R project down from an upper wall of the front holder 12 and front and rear holding portions 18F, 18R project up from a lower wall of the front holder 12. The front and rear holding portions 18F, 18R exhibit a function of holding the movable member 30 at an initial position by being locked to the deflectable locking pieces 36 of the movable member 30.

The movable member 30 is a single component made of synthetic resin and includes two bilaterally symmetrical bases 31 and a cover 32 that is long and narrow in the lateral direction. The cover 32 couples rear end parts of the left and right bases 31. A guide groove 33 is formed in an outer side surface of each of the left and right bases 31 and extends in the front-rear direction. A vertical dimension of the cover 32 is larger than the minimum facing distance between the vertically facing resilient contact pieces 21 in the free state in the board accommodation space 15 and is equal to or slightly larger than a plate thickness of the circuit board 41. The front surface of the cover 32 serves as a receiving surface 34. A central part of the receiving surface 34 in the vertical direction (plate thickness direction of the circuit board 41) is recessed from both upper and lower end parts in a side view. Upper and lower end parts of the rear surface of the cover 32 are form tapered surfaces 35 that are oblique to the front-rear direction (inserting direction of the circuit board 41 into the board accommodation space 15).

The movable member 30 includes two pairs of left and right deflectable locking pieces 36, with each pair being composed of upper and lower deflectable locking pieces 36. The upper deflectable locking piece 36 is cantilevered rearward from the upper surface of a front end part of the base 31 and is resiliently deflectable downward. The lower deflectable locking piece 36 is cantilevered rearward from the lower surface of the front end part of the base 31 and is resiliently deflectable upward. A holding projection 37 projects up on an extending end part of the upper deflectable locking piece 36, and a holding projection 37 projects down on an extending end part of the lower deflectable locking piece 36.

The movable member 30 is formed with left and right locking projections 38 for locking the circuit board 41. Each locking projection 38 projects from a front end part of an inner side surface of the base 31 and has a chevron (substantially triangular) shape in a plan view. Further, the left and right bases 31 are resiliently deflectable away from each other in the lateral direction with rear end parts thereof as supports. As the left and right bases 31 are opened away from each other, a distance between the left and right locking projections 38 increases.

Figure 2:
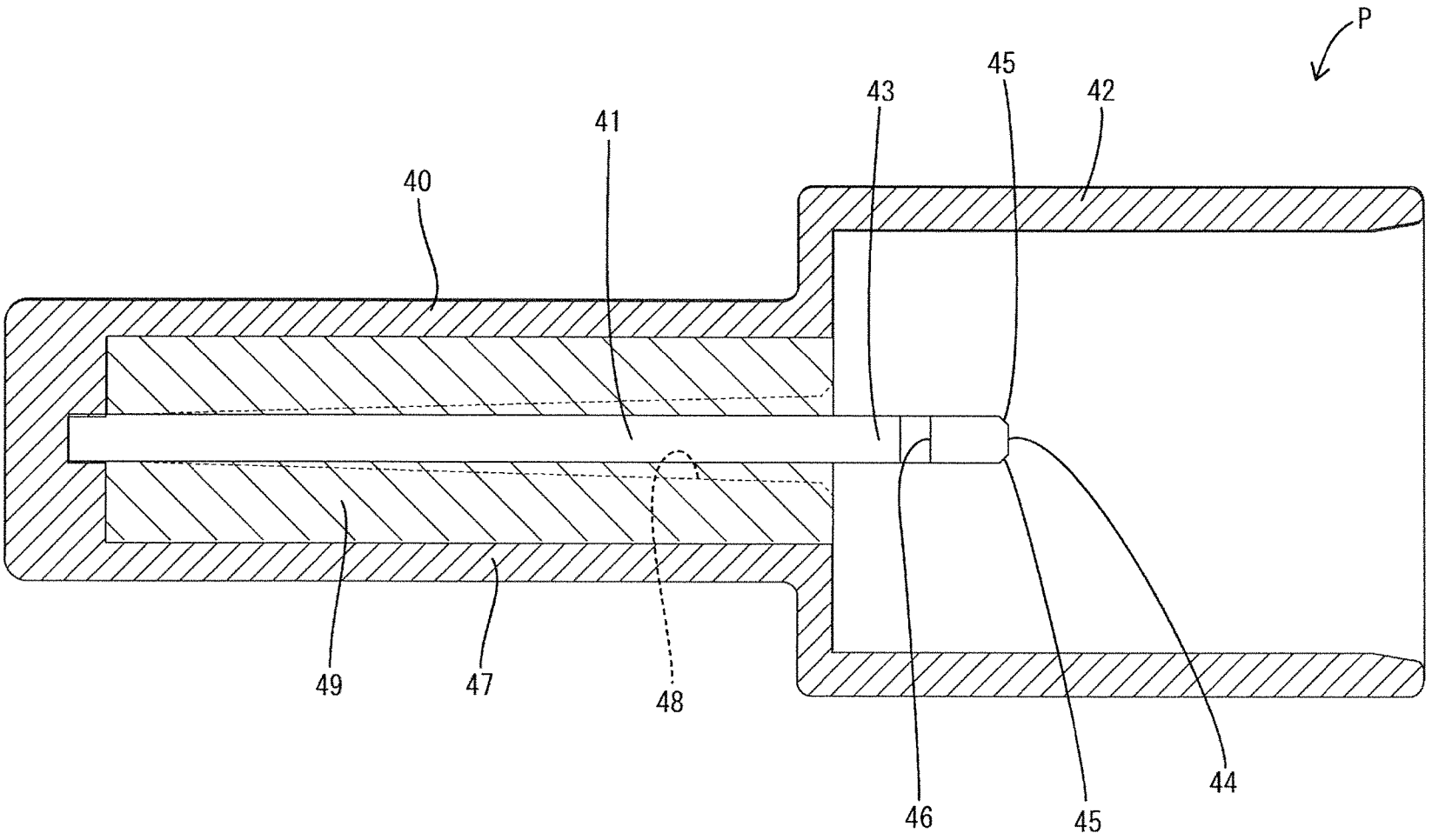
FIG. 2 is a side view in section of a board-side connector.

The board-side connector P is obtained by assembling the circuit board 41 with a board holder 40 made of synthetic resin. As shown in FIG. 2, a tapered guide 48 having is formed in a box-shaped board accommodating portion 47 of the board holder 40 and has a width and a height gradually reduced toward a back side. The board holder 40 includes a rectangular tubular receptacle 42 projecting toward the harness-side connector H from an opening edge of the board accommodating portion 47. Electronic components (not shown) are mounted and circuits are formed by printing on both upper and lower surfaces (both front and rear surfaces) of the circuit board 41.

The circuit board 41 has a connecting edge 43 to be inserted into the board accommodation space 15. Most areas of the circuit board 41 excluding the connecting edge 43 are accommodated in the board accommodating portion 47 and positioned by the guide 48. Further, a potting agent 49 is filled in a clearance between the inner surface of the board accommodating portion 47 and the circuit board 41, and the circuit board 41 is fixed to the board holder 40 by the potting agent 49. The connecting edge 43 of the circuit board 41 projects toward the housing 10 from the front surface of the board holder 40 and is surrounded by the receptacle 42.

Contact portions (not shown) to be brought into contact with the resilient contact pieces 21 of the terminal fittings 20 are disposed on each of both upper and lower surfaces of the connecting edge 43.

An inserting-direction tip surface 44 on a front side of the circuit board 41 in the inserting direction is a flat surface at a right angle to the inserting direction of the circuit board 41 into the board accommodation space 15. The inserting-direction tip surface 44 and upper and lower inserting end edges 45, which are boundaries between the inserting-direction tip surface 44 and both upper and lower surfaces of the connecting end edge portion 43 are chamfered and tapered. A pair of locking recesses 46 are formed by cutting areas of both left and right outer side surfaces of the connecting edge 43 rearward of the inserting edge 45 in the inserting direction. The locking recesses 46 have a chevron (substantially triangular) shape similar to the locking projections 38 in a plan view. The locking projections 38 of the movable member 30 are semi-locked to the locking recesses 46.

Next, functions and effects of this embodiment are described. The terminal fittings 20 are inserted into the housing 10 of the harness-side connector H and the movable member 30 is assembled with the housing 10. In assembling the movable member 30, the bases 31 and the deflectable locking pieces 36 are inserted into the guide spaces 16 from the front of the housing 10. At this time, the holding projections 37 interfere with the front holding portions 18F, and the upper deflectable locking pieces 36 are deflected resiliently down and the lower deflectable locking pieces 36 are deflected resiliently up.

The deflectable locking pieces 36 resiliently return when the holding projections 37 pass through the front holding portions 18F, and the holding projections 37 are locked while being sandwiched between the front holding portions 18F and the rear holding portions 18R. By this locking action, the movable member 30 is held at the initial position (see FIG. 1) with respect to the housing 10. With the movable member 30 located at the initial position, the cover 32 is located at an entrance 15E on the front end of the board accommodation space 15 (i.e. forward of the resilient contact pieces 21).

With the movable member 30 located at the initial position, the harness-side connector H and the board-side connector P are connected. In connecting, the board-side connector P is brought closer to the housing 10 from the front, the receptacle 42 is inserted into the connection space 14 and rear end parts of the guide grooves 33 are fit to front end parts of the guide ribs 17. Thus, the movable member 30 is positioned vertically with respect to the housing 10. Further, the outer side surfaces of the bases 31 contact the side walls of the front holder 12 so that the movable member 30 is positioned laterally with respect to the housing 10.

The connectors H, P are connected further from this state so that the inserting-direction tip surface 44 of the circuit board 41 contacts the receiving surface 34 of the movable member 30 and the locking projections 38 of the movable member 30 are fit into the locking recesses 46 of the circuit board 41. The connectors H, P then are connected further from this state so that the inserting-direction tip surface 44 pushes the receiving surface 34 (cover 32), and the movable member 30 starts entering the board accommodation space 15 integrally with the circuit board 41.

Figure 3:
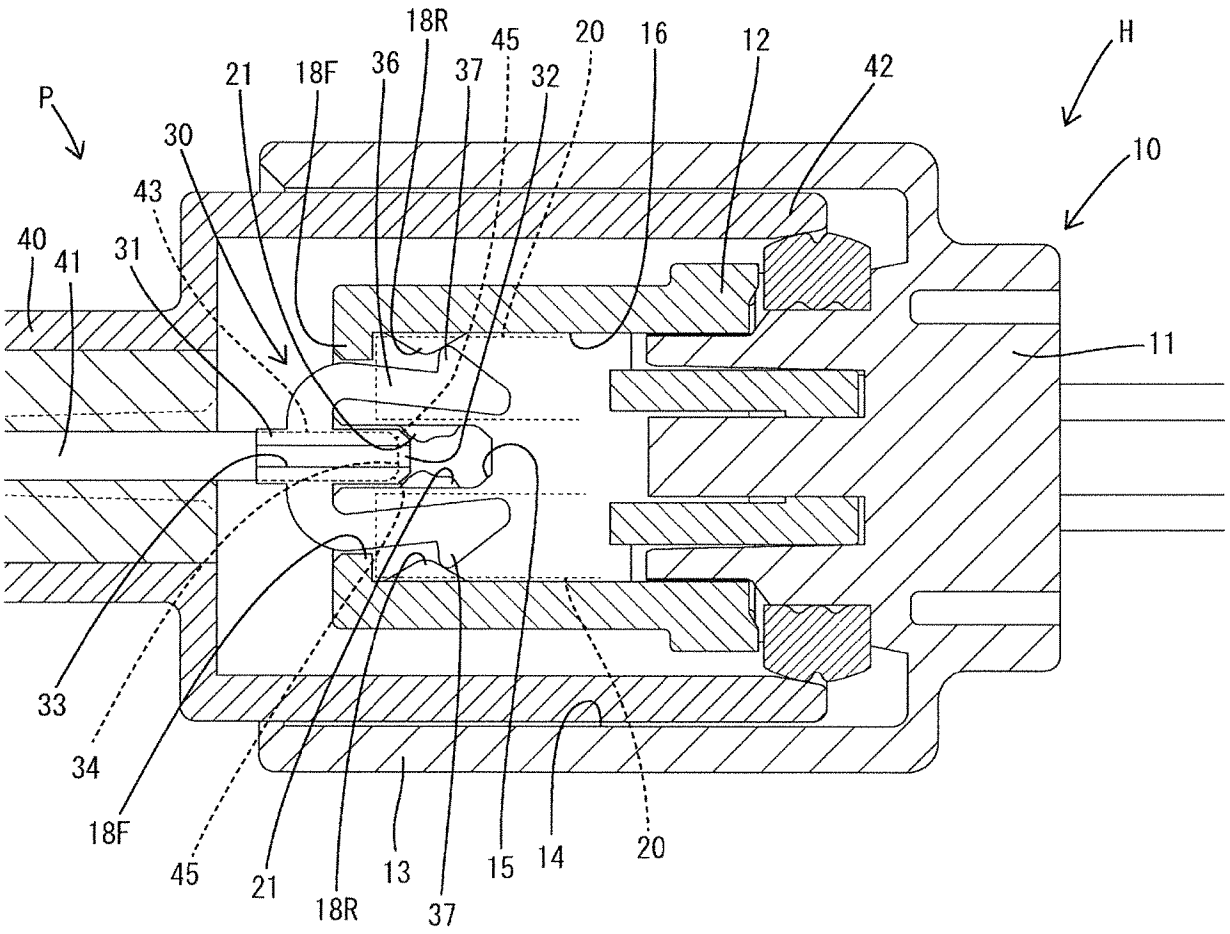
FIG. 3 is a side view in section showing the process of connecting the harness-side connector and the board-side connector.

Then, as shown in FIG. 3, the holding projections 37 move over the rear holding portions 18R while resiliently deflecting the deflectable locking pieces 36 and the tapered surfaces 35 of the cover 32 come into contact with the resilient contact pieces 21 of the terminal fittings 20. The inserting edges 45 of the circuit board 41 are located forward of the cover 32 (on a side opposite to the resilient contact pieces 21 across the cover 32). In addition, the vertically central part of the receiving surface 34 is recessed so there is no possibility that the inserting edges 45 are displaced up or down (i.e. in a direction to approach the resilient contact pieces 21) with respect to the cover 32. Thus, the inserting edges 45 do not interfere with the resilient contact pieces 21.

Figure 4:
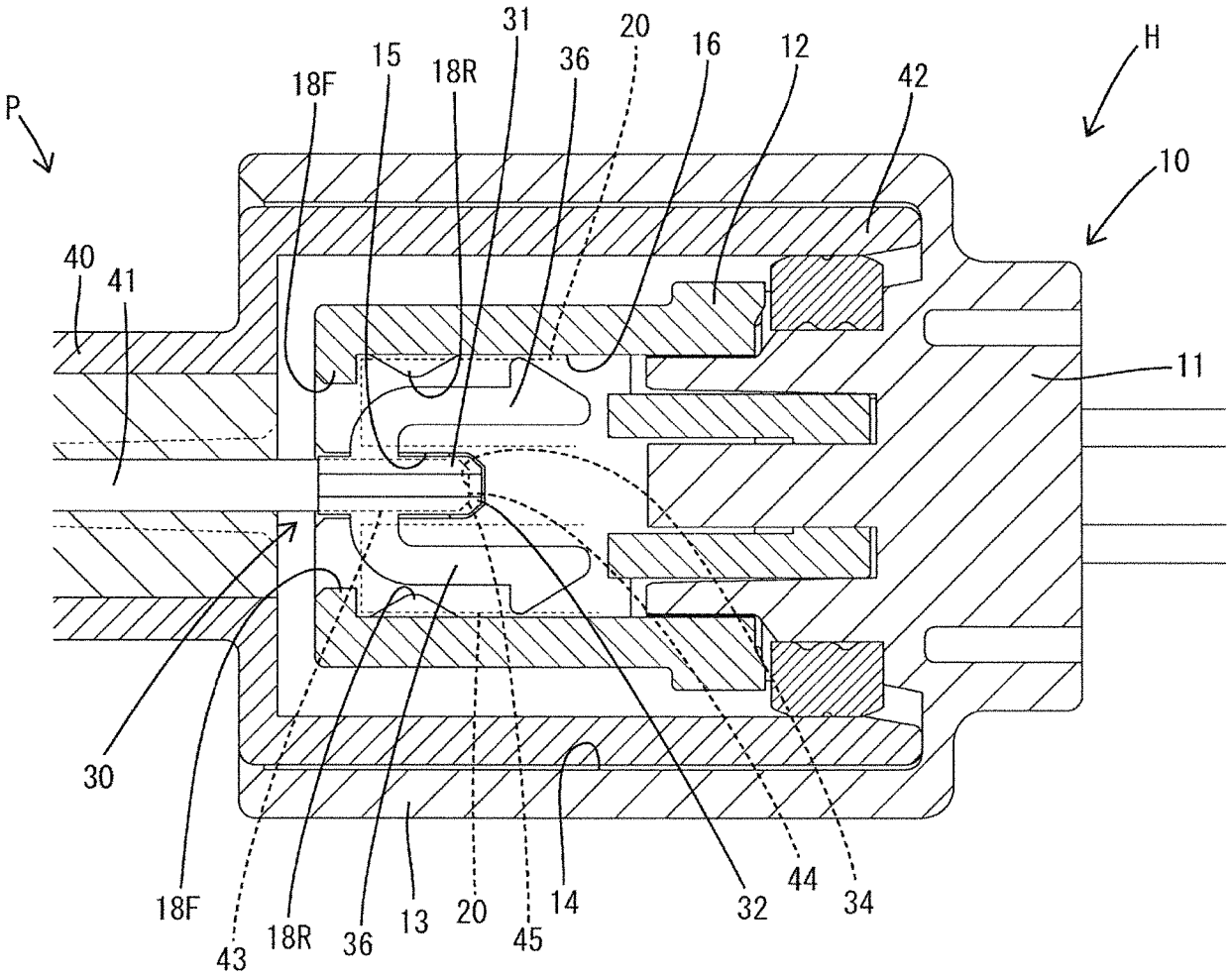
FIG. 4 is a side view in section showing the process of connecting the harness-side connector and the board-side connector.
Figure 5:
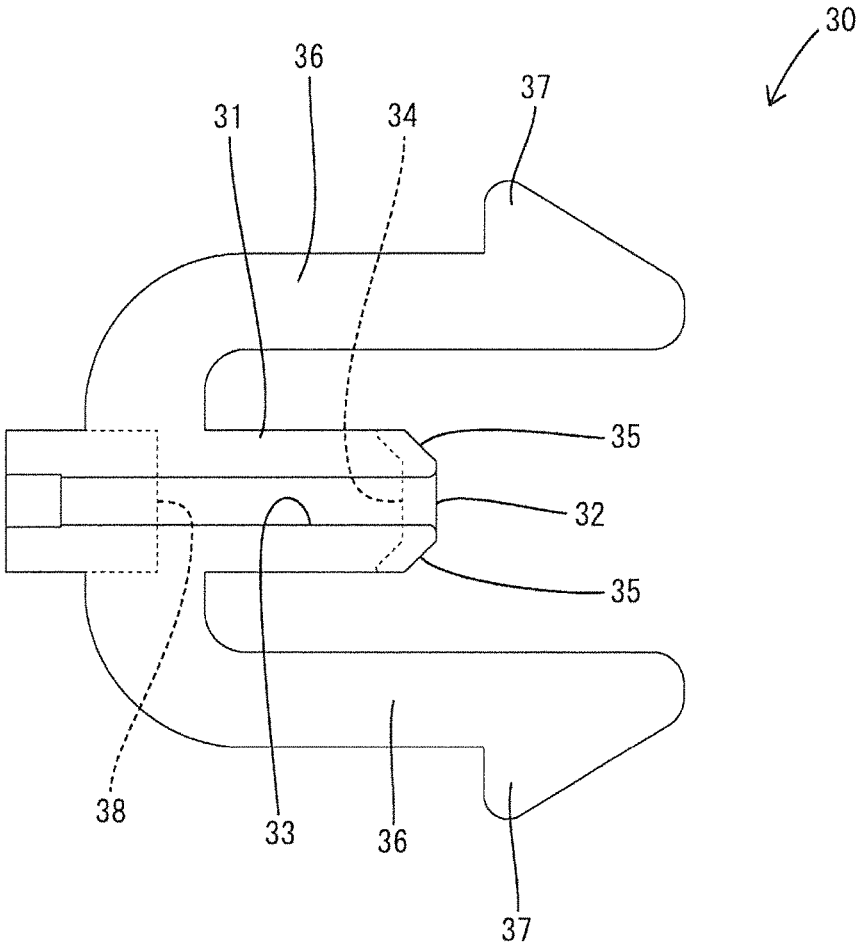
FIG. 5 is a side view of a movable member.
Figure 6:
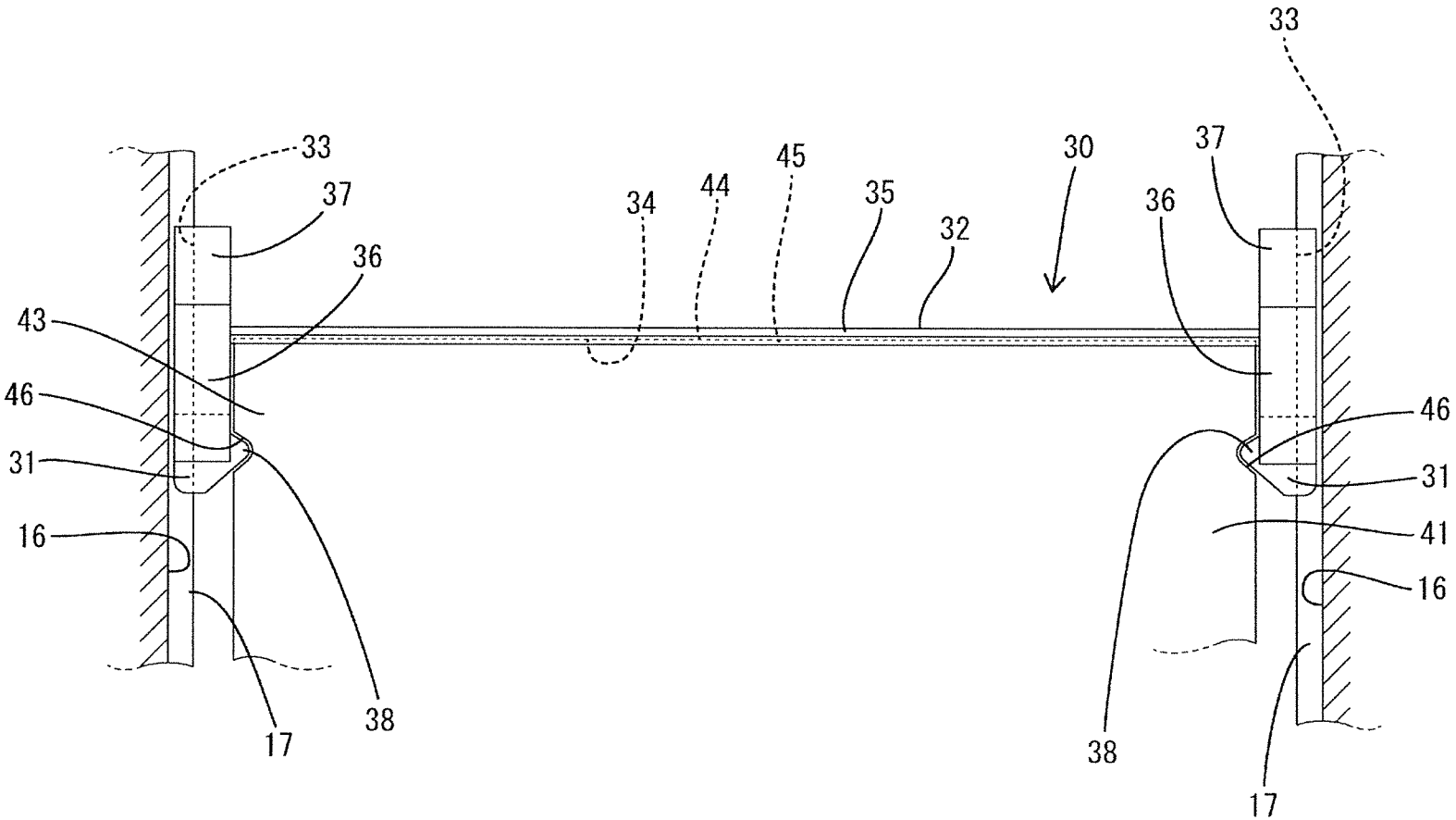
FIG. 6 is a plan view showing a state where locking projections of the movable member and locking recesses of a circuit board are locked.
Figure 7:
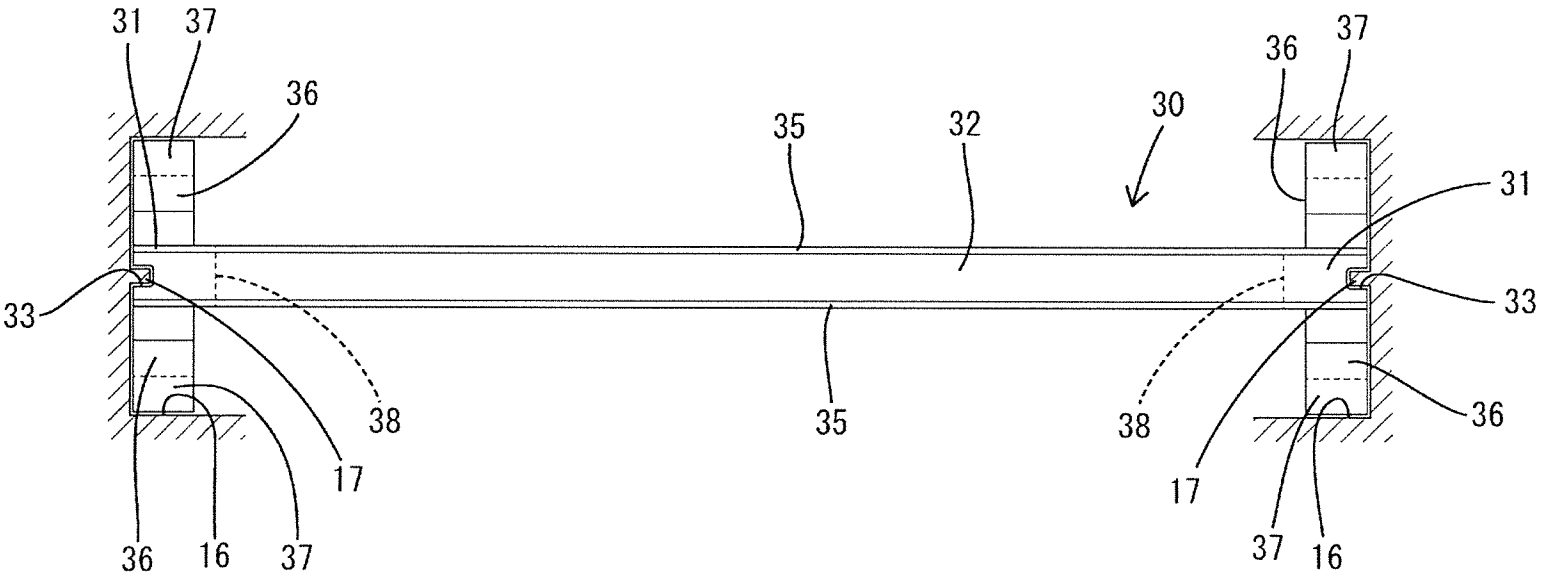
FIG. 7 is a section showing a state where the movable member is guided by guide ribs.

If the connectors H, P are connected further connected in this state, the resilient contact pieces 21 are deflected resiliently away from the board accommodation space 15 (insertion path for the circuit board 41) due to the inclination of the tapered surfaces 35. The tapered surfaces 35 are inclined with respect to the inserting direction of the circuit board 41. Thus, even if the cover 32 contacts the resilient contact pieces 21, there is no possibility that the cover 32 is shaved or deformed. When the connectors H, P reach a properly connected state, as shown in FIG. 4, the inserting edges 45 of the circuit board 41 pass over the resilient contact pieces 21 without interfering with the resilient contact pieces 21. Then, the resilient contact pieces 21 contact the contact portions of the circuit board 41 with a predetermined contact pressure due to resilient restoring forces thereof. Further, the movable member 30 moved integrally with the circuit board 41 reaches a connection position.

The board-side connector P is pulled forward of the harness-side connector H to separate the connected connectors H, P and to withdraw the circuit board 41 from the board accommodation space 15. At this time, the locking recesses 46 of the circuit board 41 and the locking projections 38 of the movable member 30 are fit and locked. Thus, the movable member 30 moves toward the initial position integrally with the circuit board 41 as the circuit board 41 moves forward. The holding projections 37 interfere with the rear holding portions 18R during this time, and the deflectable locking pieces 36 are deflected resiliently.

The holding portions 37 butt against the front holding portions 18F when the movable member 30 reaches the initial position. Therefore further forward movement of the movable member 30 is restricted. The locking projections 38 and the locking recesses 46 are semi-locked. Thus, the bases 31 of the movable member 30 are, thereafter, laterally opened and the locking projections 38 are separated from the locking recesses 36 as the circuit board 41 is withdrawn from the board accommodation space 15. In this way, only the circuit board 41 is withdrawn from the board accommodation space 15 while the movable member 30 is kept at the initial position.

As described above, the card edge connector of this embodiment includes the circuit board 41 and the housing 10. The board accommodation space 15 is formed in the housing 10 and is configured such that the circuit board 41 is inserted therein from the front of the housing 10, and the terminal fittings 20 are mounted in the housing 10. The terminal fitting 20 is provided with the resilient contact piece 21 capable of resiliently contacting the circuit board 41 inserted into the board accommodation space 15. The housing 10 is provided with the movable member 30 and the movable member 30 is formed with the cover 32 for covering the inserting edges 45 on the tip of the circuit board 41 in the inserting direction into the board accommodation space 15 when the circuit board 41 is inserted into the board accommodation space 15.

Further, the movable member 30 is guided to be movable between the initial position where the covering portion 32 is located at the entrance 15E of the board accommodation space 15 and the connection position where the cover 32 is located backward of the resilient contact pieces 21 by fitting the guide grooves 33 formed in the movable member 30 and the guide ribs 17 formed in the housing 10. Further, the movable member 30 is formed with the receiving surface 34 for moving the movable member 30 integrally with the circuit board 41 to the back of the board accommodation space 15 by being pushed by the circuit board 41, and the movable member 30 is moved integrally with the circuit board 41 in a direction to be withdrawn from the board accommodation space 15 by locking the locking recesses 46 formed in the circuit board 41 and the locking projections 38 formed on the movable member 30 to each other.

According to this configuration, the cover 32 covers the inserting edges 45 of the circuit board 41 when inserting the circuit board 41 into the board accommodation space 15. Therefore, there is no possibility that the resilient contact pieces 21 of the terminal fittings 20 interfere with the inserting edges 45 of the circuit board 41. Thus, a contact failure due to the interference of the resilient contact pieces 21 and the inserting edges 45 of the circuit board 41 can be prevented. Further, in withdrawing the circuit board 41 from the board accommodation space 15 after the circuit board 41 is moved to the back side of the board accommodation space 15 while pushing the movable member 30, the movable member 30 returns to the initial position integrally with the circuit board 41 due to the locking action of the locking projections 38 and the locking recesses 46. Thus, even if the circuit board 41 repeatedly is inserted into and withdrawn from the board accommodation space 15, the interference of the inserting edges 45 of the circuit board 41 and the resilient contact pieces 21 of the terminal fittings 20 can be prevented.

The movable member 30 is formed with the deflectable locking pieces 36 and the housing 10 is formed with the holding portions 18F, 18R for holding the movable member 30 at the initial position by locking the deflectable locking pieces 36. According to this configuration, in withdrawing the circuit board 41 from the board accommodation space 15, the movable member 30 can be held at the initial position by the holding portions 18F, 18R. Thus, the movable member 30 need not be mounted into the housing 10 when the circuit board 41 is inserted into the board accommodation space 15 again.

Further, the cover 32 is long and narrow in the lateral direction along the board accommodation space 15 and the pairs of the deflectable locking pieces 36 are connected to both end parts of the cover 32. According to this configuration, the movable member 30 can be held at the initial position without being inclined in a plan view by locking the pairs of deflectable locking pieces 36 and the holding portions 18F, 18R to each other. Further, the receiving surface 34 is formed on the cover 32. Thus, the shape of the movable member 30 is simplified The invention is not limited to the above described and illustrated embodiment. For example, the following embodiments also are included in the scope of the invention.

Although the receiving surface is formed on the cover in the above embodiment, the receiving surface may be formed on a part different from the cover.

The movable member is held at the initial position by locking the deflectable locking pieces to the holding portions in the above embodiment. However, the movable member may be withdrawn together with the circuit board in withdrawing the circuit board from the board accommodation space.

Although the terminal fittings are arranged to face the both front and rear surfaces of the circuit board in the above embodiment, the terminal fittings may face only either one of the front and rear surfaces of the circuit board.

The inserting edges, which are the boundaries between the inserting-direction tip surface of the circuit board and the upper and lower surfaces of the connecting edge are chamfered and tapered in the above embodiment. However, the inserting end edge portions of the circuit board may be right-angular without being chamfered and tapered.

LIST OF REFERENCE SIGNS

10 . . . housing
15 . . . board accommodation space
15E . . . entrance of board accommodation space
17 . . . guide rib (guide portion)
18F, 18R . . . holding portion
20 . . . terminal fitting
21 . . . resilient contact piece
30 . . . movable member
32 . . . cover
33 . . . guide groove (guide portion)
34 . . . receiving surface
36 . . . deflectable locking piece
38 . . . locking projection (locking portion)
41 . . . circuit board
45 . . . inserting edge
46 . . . locking recess (locking portion)

The invention claimed is:

1. A card edge connector, comprising:

a circuit board;

a housing;

a board accommodation space formed in the housing and configured such that the circuit board is inserted thereinto from front of the housing;

a terminal fitting mounted in the housing;

a resilient contact piece provided on the terminal fitting and capable of resiliently contacting the circuit board inserted into the board accommodation space;

a movable member provided in the housing;

a cover formed on the movable member and configured to cover an inserting end edge portion on a tip of the circuit board in an inserting direction into the board accommodation space when the circuit board is inserted into the board accommodation space;

a guide configured to guide the movable member movably between an initial position where the cover is located at an entrance of the board accommodation space forward of the resilient contact piece and a connection position where the cover is located backward of the resilient contact piece;

a receiving surface formed on the movable member and configured to move the movable member integrally with the circuit board to a back side of the board accommodation space by being pushed by the circuit board; and locking portions formed on the circuit board and the movable member to be lockable to each other and configured to move the movable member integrally with the circuit board in a withdrawing direction from the board accommodation space.

2. The card edge connector of claim 1, wherein the receiving surface is formed on the cover.

3. The card edge connector of claim 1, wherein:

the movable member is formed with a deflectable locking piece; and the housing is formed with a holding portion configured to hold the movable member at the initial position by locking the deflectable locking piece.

4. The card edge connector of claim 3, wherein:

the cover is long and narrow along the board accommodation space; and two deflectable locking pieces connected respectively to both end parts of the cover.

* * * * *